United States Patent [19]

Otomo

[11] Patent Number: 4,726,460

[45] Date of Patent: Feb. 23, 1988

[54] FRAME STRUCTURE FOR A CURVED ESCALATOR

[75] Inventor: Yoshimi Otomo, Inazawa, Japan

[73] Assignee: Mitsubishi Denki Kabushiki Kaisha, Japan

[21] Appl. No.: 915,865

[22] Filed: Oct. 7, 1986

Related U.S. Application Data

[63] Continuation of Ser. No. 669,002, Nov. 7, 1984, abandoned.

[30] Foreign Application Priority Data

| | | | |
|---|---|---|---|
| Nov. 11, 1983 | [JP] | Japan | 58-211827 |
| Nov. 11, 1983 | [JP] | Japan | 58-211828 |
| Nov. 11, 1983 | [JP] | Japan | 58-211829 |
| Nov. 11, 1983 | [JP] | Japan | 58-211830 |
| Nov. 11, 1983 | [JP] | Japan | 58-211831 |

[51] Int. Cl.[4] ..... B66B 21/02

[52] U.S. Cl. ..... 198/328; 198/778

[58] Field of Search ..... 198/321, 326, 328, 778, 198/860.1, 860.2; 182/93, 178; 52/108, 187, 639–645, 690–696

[56] References Cited

U.S. PATENT DOCUMENTS

| | | | |
|---|---|---|---|
| 705,794 | 7/1902 | Snider | 52/187 |
| 2,633,970 | 4/1953 | Robinson | 198/346 |
| 2,695,094 | 11/1954 | Riley | 198/323 |
| 2,793,738 | 5/1957 | Erickson | 198/860.1 |
| 2,823,785 | 2/1958 | Hefti | 198/328 |
| 3,185,108 | 5/1965 | Muller | 198/321 |
| 3,664,487 | 5/1972 | Ballenger | 198/778 |
| 3,707,220 | 12/1972 | Boltrek et al. | 198/330 |
| 3,857,476 | 12/1974 | Heifetz et al. | 198/778 |
| 4,064,986 | 12/1977 | Bertovich | 198/326 |
| 4,259,825 | 4/1981 | Hedgepeth et al. | 52/645 |
| 4,326,624 | 4/1982 | Ewertowski et al. | 198/346.1 |
| 4,475,323 | 10/1984 | Schwartzberg et al. | 52/645 |
| 4,549,634 | 10/1985 | Duncan et al. | 182/178 |

FOREIGN PATENT DOCUMENTS

| | | | |
|---|---|---|---|
| 0103489 | 3/1984 | European Pat. Off. . | |
| 601565 | 10/1930 | Fed. Rep. of Germany | 198/328 |
| 3247231 | 7/1983 | Fed. Rep. of Germany | 198/860.2 |
| 807933 | 1/1937 | France | 198/328 |
| 1200297 | 12/1959 | France . | |
| 48-25559 | 7/1973 | Japan | 198/328 |
| 159066 | 6/1957 | Sweden | 198/321 |
| 836292 | 6/1960 | United Kingdom | 198/326 |

*Primary Examiner*—Joseph E. Valenza
*Assistant Examiner*—Jonathan D. Holmes
*Attorney, Agent, or Firm*—Leydig, Voit & Mayer

[57] ABSTRACT

A frame structure for a curved escalator comprises a plurality of truss units connected to each other to define an arc in plan, the frame structure having upper and lower horizontal sections and a sloped section therebetween. The frame structure further comprises an upper transition section including at least one truss unit and connected between the upper horizontal section and the sloped section, and a lower transition section including at least one truss unit and connected between the lower horizontal section and the sloped section.

5 Claims, 11 Drawing Figures

FRAME STRUCTURE FOR A CURVED ESCALATOR

This application is a continuation of application Ser. No. 669,002, filed Nov. 7, 1984, now abandoned.

BACKGROUND OF THE INVENTION

This invention relates to curved escalators and more particularly to frame structures for a curved escalators having a circular stairway path that has a circular horizontal projection.

Curved escalators include a frame structure defining therein a stairway path along which a plurality of segment steps travel. The stairway path includes upper and lower horizontal landing sections and an intermediate inclined section connected between the upper and lower landing sections.

As illustrated in FIGS. 1 and 2, a curved escalator 1 has a stairway path 2 of a spiral or circular in horiziontal projection along which a plurality of segment steps 3 travel. The steps 3 are connected to an endless belt 5 mounted within a frame structure 4 and are driven by a drive unit 6. Endless moving handrails 7 are also disposed for synchronized movement with the steps 3 on the endless belt 5. One of the proposed structures for the main frame structure 4 of a curved escalator utilizes a plurality of truss units, each of which is comprised of upper and lower cord members and vertical members, connected to each other to define a curved or circular frame structure 40 as shown in FIG. 3, in which the frame structure 40 is illustrated in a plan view. As shown in the figure, the frame structure 40 comprises truss units 40*a*, 40*b*, 40*c* . . . 40*n* which are connected to each other and arranged along a curve formed by smoothly connected arcs having radii of curvature $R_1$ to $R_5$ with respect to the centers $O_1$ to $O_5$ to form a polygonal truss structure. The frame structure 40 has upper and lower horizontal sections along which the upper and lower landing sections of the stairway path are defined, and an intermediate, inclined section along which the sloped section of the stairway path is defined.

However, according to the prior design described above, the upper and lower horizontal sections of the frame structure and the inclined section of the frame structure are directly connected with a single angled point therebetween. That is, the horizontal section of the frame structure abruptly changes into the inclined section, and the cord (as used herein, "cord" and/or "cordal" refer to certain non-vertical structural members as well as a straight line joining two points on an arc) member of the horizontal section must be angled at a relatively large angle to change into the cord member of the inclined section. The cord members have mounted thereon vertical members which carry cross members extending between outer and inner side members, and guide rails for guiding the steps of the escalator are mounted to the cross members to extend along the stairway path of the escalator.

With the above arrangement, since the cord members are connected at the bent point or the connecting point between the horizontal section and the sloped section, the vertical distance between the top face of the truss and the tread of the guide rail is not constant at the position at which the vertical member is mounted, requiring much time and money to accurately position the guide rails.

Further, since the truss members have varying cross sections, mounting brackets to be supported from the truss members must be formed accordingly, resulting in an increased number of parts and cost.

Also, since the positioning of the vertical member is very complicated, the assembly of the vertical member that is vertically disposed between the upper and the lower cord members is complicated and difficult. The positioning of the truss members is also difficult. Further, the positioning of the guide rails in the radial direction within truss units arranged along a curve is difficult because the truss units themselves are constructed of straight truss members.

SUMMARY OF THE INVENTION

Accordingly, an object of the present invention is to provide a frame structure for a curved escalator in which the positioning and aligning of the guide rails are relatively easy.

Another object of the present invention is to provide a frame structure for a curved escalator in which the assembling of the vertical truss members between the upper and the lower cord members is easy.

Still another object of the present invention is to provide a frame structure for a curved escalator in which the connecting and positioning of the truss units can be easily achieved.

Still another object of the present invention is to provide a frame structure for a curved escalator in which the positioning of the guide rails in the radial direction, manufacturing of the truss units, and assembly of the truss are facilitated.

Still a further object of the present invention is to provide a frame structure for a curved escalator in which the truss unit may be manufactured using the end faces at which they are connected as a reference position whereby the assembly of the main frame structure is facilitated, and in which the connecting accuracy of the respective truss units is improved.

With the above objects in view, a frame structure for a curved escalator of the present invention includes a plurality of truss units connected to each other to define an arc in plan, and the frame structure has upper and lower horizontal sections and a sloped section between the upper and lower sections. The frame structure comprises an upper transition section including a plurality of truss units connected between the upper horizontal section and the sloped section, and a lower transition section including a plurality of truss units connected between the lower horizontal section and the sloped section.

BRIEF DESCRIPTION OF THE DRAWINGS

The present invention will become more readily apparent from the following detailed description of the preferred embodiment taken in conjunction with the accompanying drawings, in which.

DESCRIPTION OF THE PREFERRED EMBODIMENT

Figure 1:
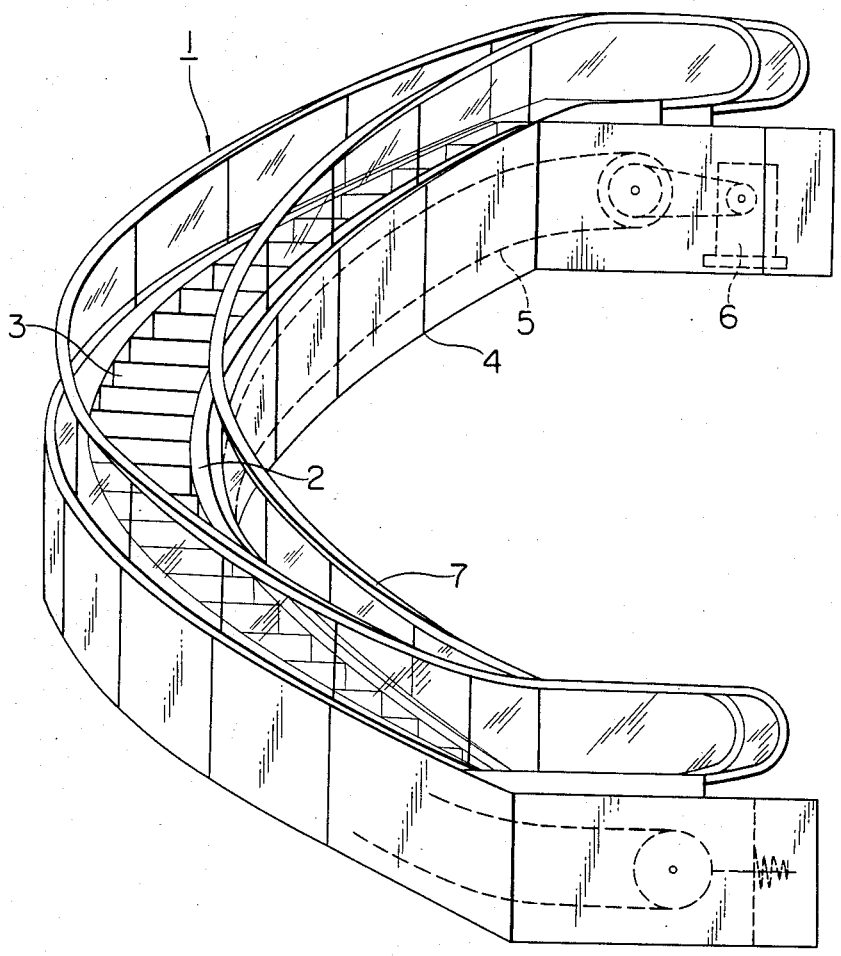
FIG. 1 is a side view of a curved escalator to which the present invention is applicable.
Figure 2:
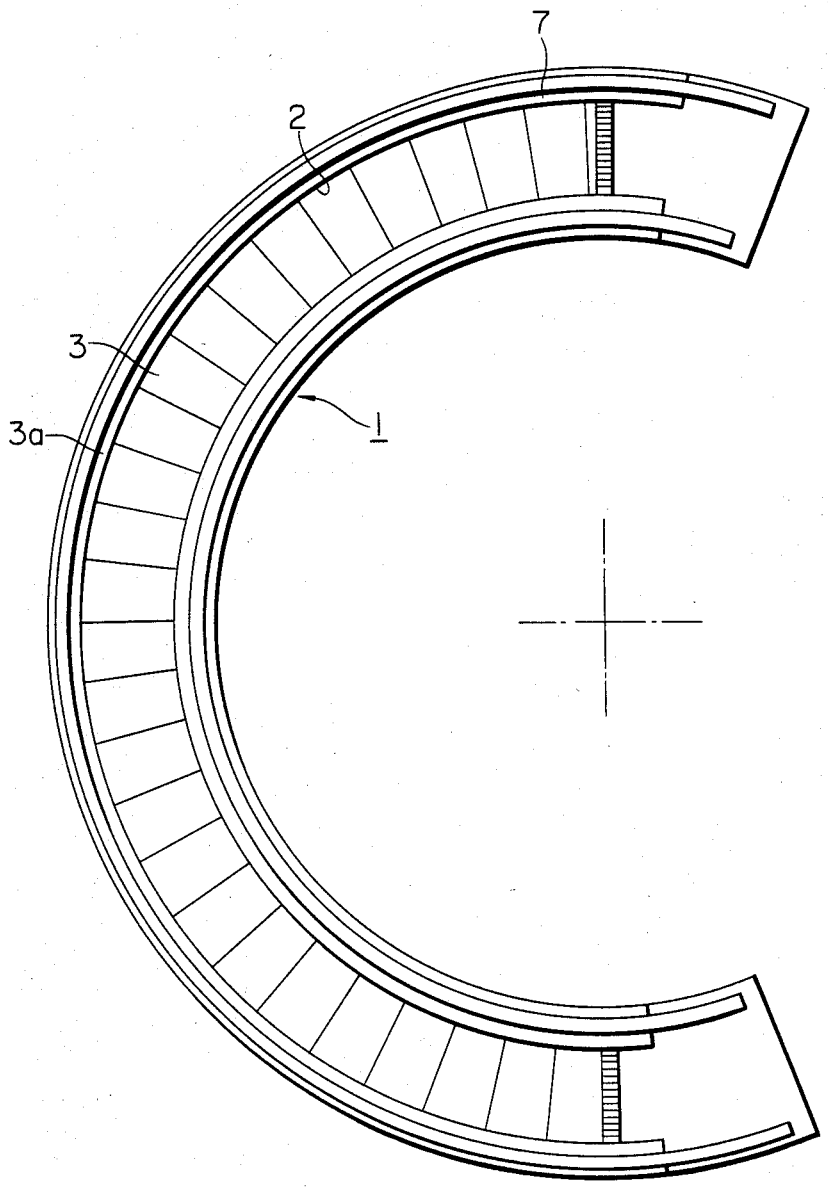
FIG. 2 is a plan view of the curved escalator shown in FIG. 1.

Referring now to FIGS. 4 to 11 in which a preferred embodiment of the present invention is illustrated, a frame structure for a curved escalator of the present invention comprises inner and outer structures 40, each comprised of a plurality of truss units 40*a*, 40*b*, 40*c*, . . . 40*n*, each truss unit includes an upper cord member 41, lower cord member 42, vertical members 43 disposed between the upper and the lower cord members 41 and 42, and diagonal members 44 disposed along a diagonal line of a parallelogram defined by the cord and vertical members. It is to be noted that the truss structures 40 include an outer truss structure shown in FIG. 4 and an inner truss structure shown in FIG. 5 which are similar but are different in their length and inclination. According to the present invention, each truss structure 40 comprises horizontally extending upper and lower landing sections H, an intermediate sloped section S, and upper and lower transition sections B that smoothly connect the respective ends of the sloped section S to the horizontal sections H. In the illustrated embodiment, the upper and lower horizontal sections H each include four truss units which form identical rectangular parallelograms, and the intermediate sloped section S includes eight truss units which are identical parallelograms, and the upper and the lower transition sections B each include two truss units which are parallelograms having varying slope angles. It is to be understood that the number of truss units contained in each of these respective sections may be modified in accordance with the design requirement of the particular curved escalator to be built.

Figure 4:
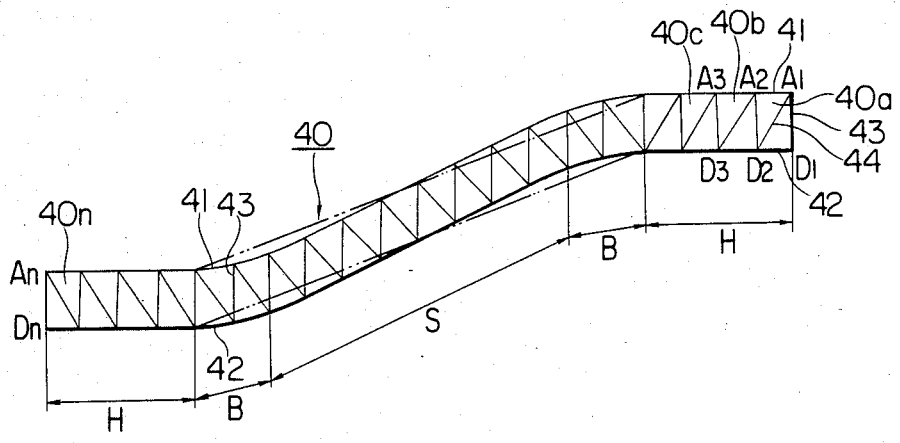
FIG. 4 is an extended schematic side view of the outer truss of an embodiment of the present invention.
Figure 5:
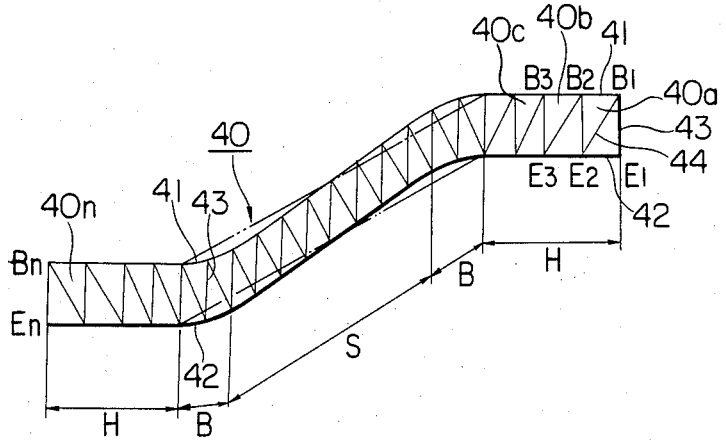
FIG. 5 is an extended schematic side view of the inner truss of an embodiment of the present invention.
Figure 6:
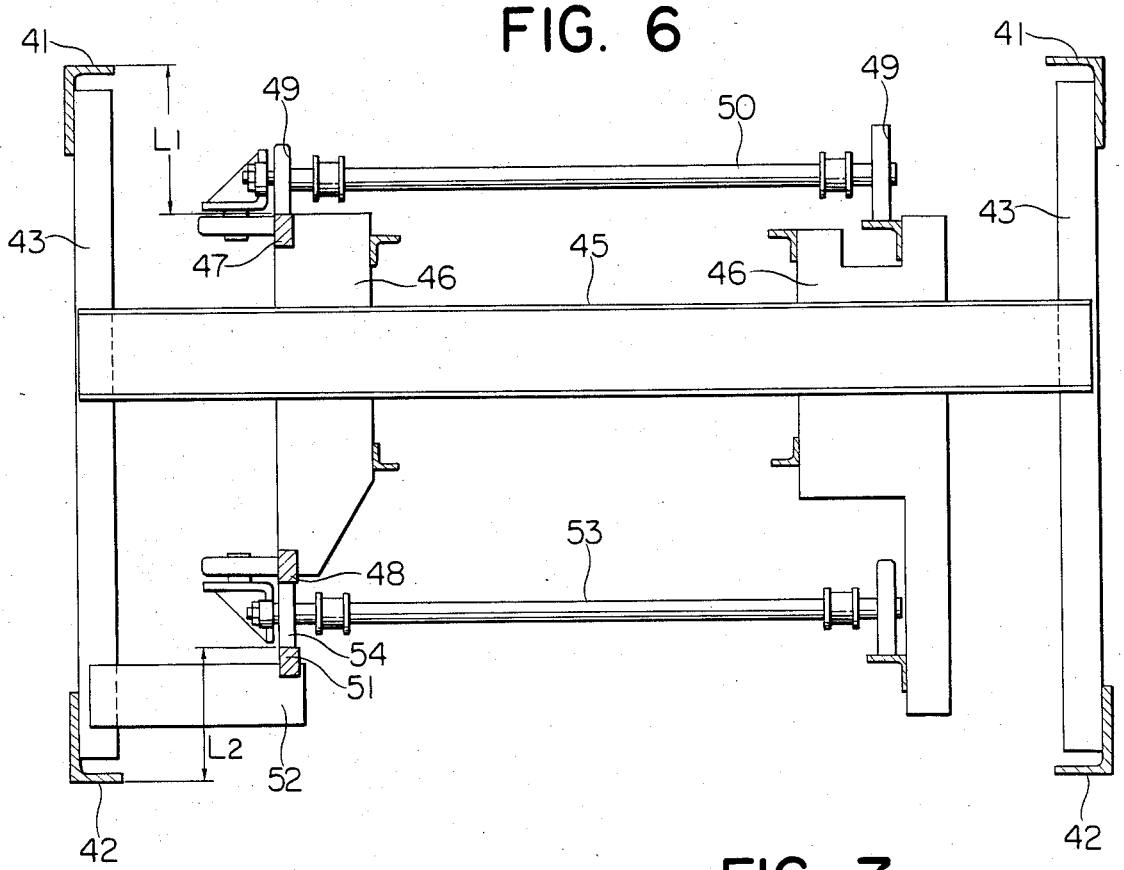
FIG. 6 is a cross sectional view taken along a vertical plane across the frame structure of the escalator.

As is best seen from FIGS. 4 and 5, the frame structure of the present invention comprises two transition sections B that smoothly connect the horizontal sections H to the sloped section S. Further, the bent points along the plan curve of each truss structure at which cordal members of the transition sections B are joined are provided with vertical truss members 43. More particularly, as shown in FIG. 6, in which a cross-sectional view of the frame structure is illustrated, the vertical truss members 43 are connected in a vertical position between the upper cord member 41 and the lower cord member 42, and between these vertical truss members 43 is connected a horizontal transverse cross beam 45 lying along a local radius of curvature of the plan-form arc of the frame structure. Mounted on the cross beam 45, via rail brackets 46, are an upper guide rail 47 and a lower guide rail 48. Disposed on the guide rail 47, providing for a rolling movement therealong, is a drive roller 49 mounted on a step axle 50 having mounted thereon a step (not shown) and connected by an endless sprocket chain, as is well known in the art.

Another guide rail 51 is positioned in an opposing relationship relative to the lower guide rail 48 by a mounting bracket 52 secured to a vertical truss member 43, which is arranged in accordance with the rate of curvature of the frame structure. A follower roller 54 mounted on an axle 53 is disposed between the lower guide rail 48 and the rail 51 for providing a guided rolling movement along the rails 48 and 51. In FIG. 6, a vertical distance between the top flange of the upper cord member 41 and the top of the upper guide rail 47 is shown by symbol $L_1$, and the vertical distance between the bottom flange of the lower cord member 42 and the top of the rail 51 is shown by symbol $L_2$.

With the above described embodiment of the present invention, since each of the truss units 40*a* to 40*n* of the inner and outer truss structures 40 includes a vertical truss member 43, and since the truss structure 40 has the angled juncture points of its cordal members in registry with the vertical truss member 43. The horizontal transverse cross beam 45, vertical members 43, and the juncture points of the cordal members all lie in a common vertical plane containing the local radius of curvature of the frame structure. The vertical distance $L_1$ and $L_2$ shown in FIG. 6 can be made constant throughout the frame structure and the points at which the cordal members join can be used as a reference point for the positioning of the guide rails. This is a significant improvement over a conventional frame structure for a curved escalator in which it is difficult to provide a positioning reference point for accurately positioning guide rails that have complex curved shapes. With the present invention, the mounting brackets for the guide rails secured to the vertical truss member can be made identical, reducing number of the types of parts and the number of assembly steps required, thereby decreasing the manufacturing cost of the escalator.

Also, since the vertical truss members 43 are arranged along the curves of the truss structures 40, the rail brackets 46 and 52 may be positioned with the outside or the inside vertical truss member 43 being used as a positioning reference, thereby facilitating the positioning of the rails 47, 48 and 51.

Figure 3:
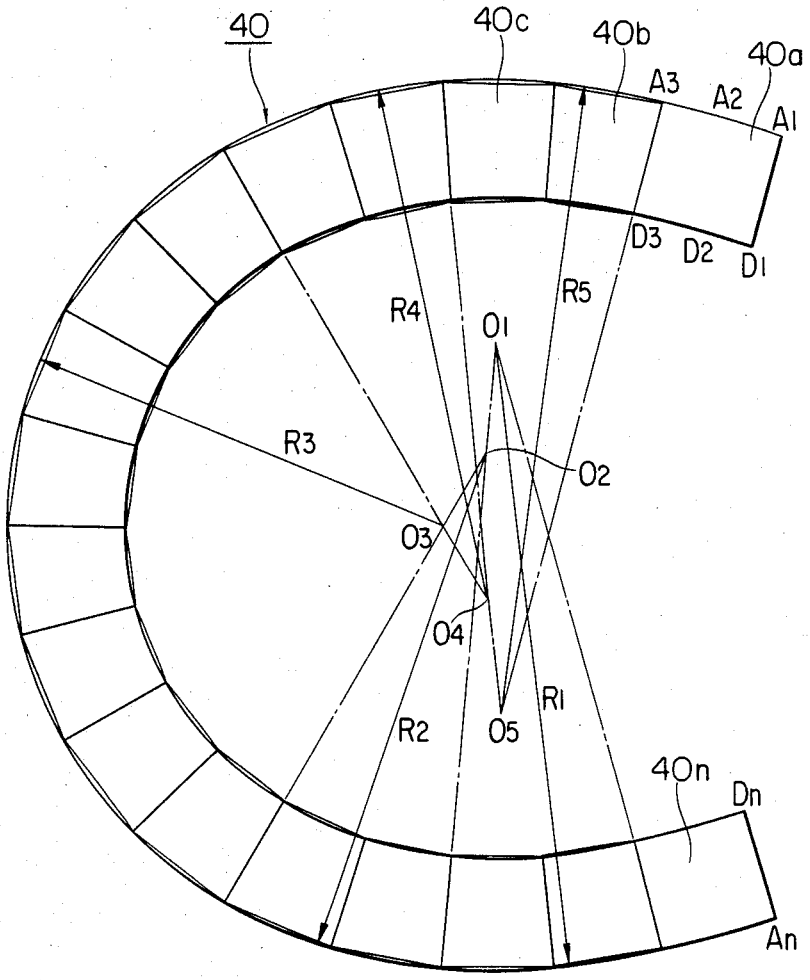
FIG. 3 is a plan view of a frame structure to which the present invention is applicable.
Figure 7:
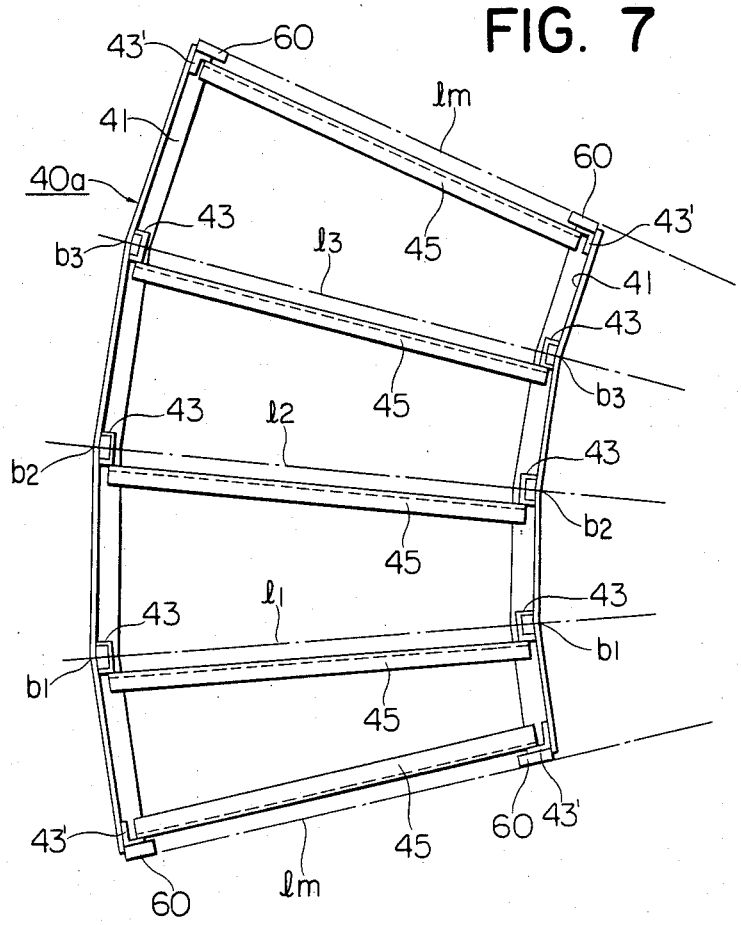
FIG. 7 is a partial plan view of the frame structure of the present invention.
Figure 8:
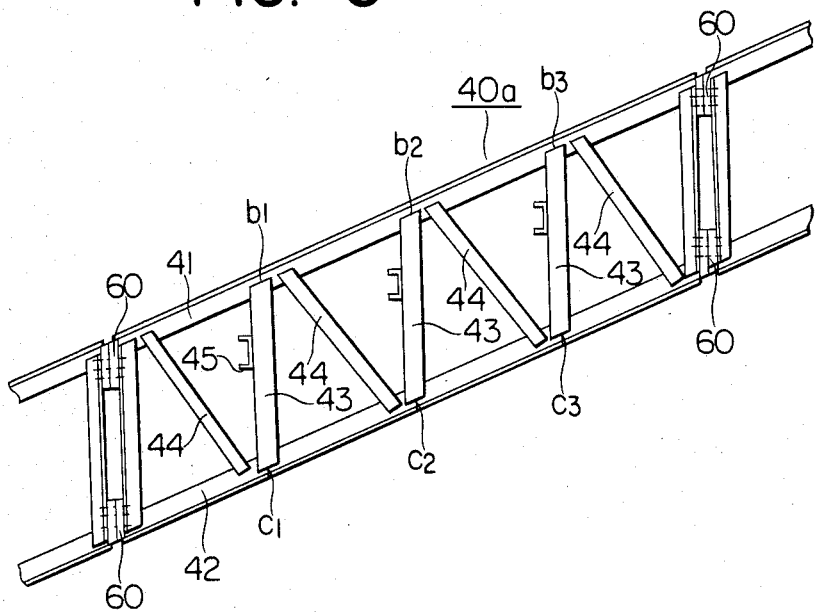
FIG. 8 is a partial side view of the outer truss structure of one embodiment of the present invention.
Figure 9:
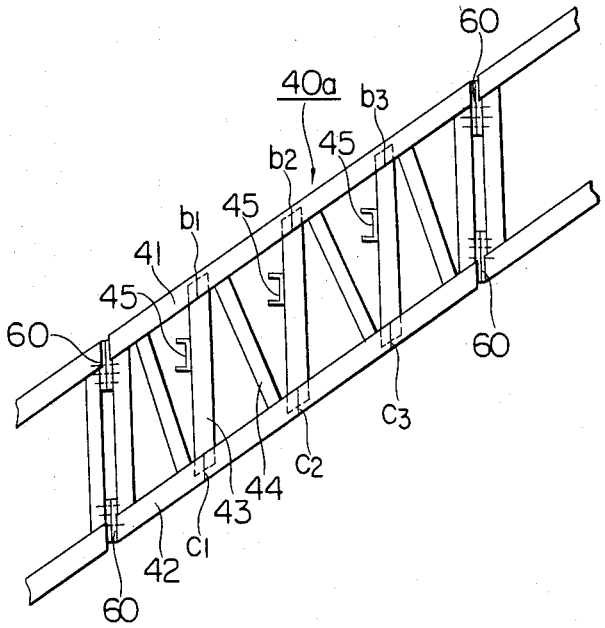
FIG. 9 is a partial side view of the inner truss structure of one embodiment of the present invention.

In this embodiment, the upper and the lower cordal truss members 41 and 42 of truss units 40*a* to 40*n* of the outer and the inner truss structures 40 are joined at an angle at the positions at which the vertical truss members 43 are secured to form a portion of a polygon in plan, as seen in FIG. 7. The angles at which the cordal truss members 41 and 42 join cordal members of adjacent truss units are such that the cord truss members, when joined, extend substantially along the arcs having centers $O_1$ to $O_5$ and radii $R_1$ to $R_5$ as shown in FIG. 3. Since the cord members are joined as described, the vertical members 43 can be easily secured at the joining points $b_1$ to $b_3$ and $c_1$ to $c_3$ as shown in FIGS. 7 to 9. The cross members 45 on which the rails are secured are mounted on the vertical members 43 are positioned along the straight lines $1_1$, $1_2$, and $1_3$ which also pass through the outer and inner juncture points at $b_1$-$b_1$, $b_2$-$b_2$, and $b_3$-$b_3$, as shown in FIG. 7.

Since the vertical truss members 43 are disposed at the juncture points of the upper and the lower cord members of the truss units and are thus aligned on the lines passing through the center of curvature of the escalator, the cross members for supporting the guide rails, the vertical members and juncture points all lie in a common plane containing a local radius of curvature. The frame structure is thus formed of frame units consisting of two radial faces lying in a vertical plane, each containing the local radius of curvature and defined by two vertical members and one horizontal member, rigidly joined together by four cordal members. Therefore, the guide rails can be easily and accurately positioned in the planes of the faces of each frame unit using the vertical and horizontal members as reference points.

The juncture points lying on $b_1$-$c_1$, $b_2$-$c_2$, and $b_3$-$c_3$ shown in FIGS. 8 and 9 may be bending points along continuous members having cordal sections lying generally along the curves of the truss structures 40.

Figure 10:
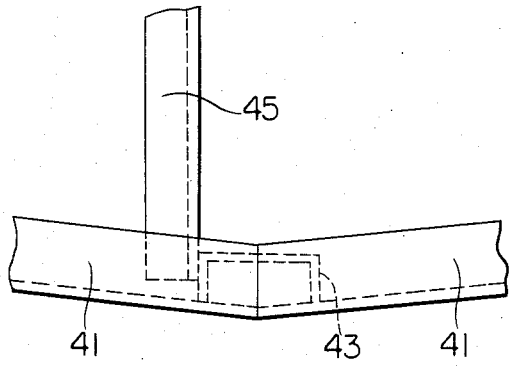
FIG. 10 is a partial enlarged plan view of a folded cord member of one embodiment of the present invention.
Figure 11:
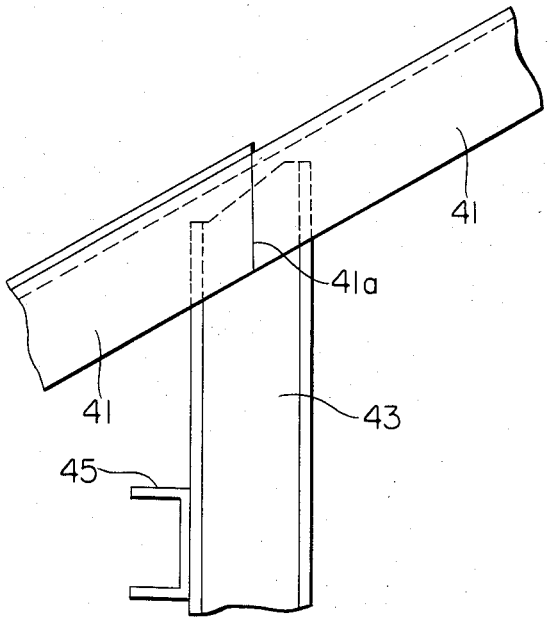
FIG. 11 is a partial enlarged side view of the folded cord member shown in FIG. 10.

FIGS. 10 and 11 are enlarged plan and side views, respectively, of a vertical juncture point of cordal truss members 41 at a face of a frame unit. The upper end of the vertical truss member 43 is rigidly secured to the upper cord member 41 and the lower end of the vertical truss member 43 is similarly secured to the lower cord truss member 42.

With this arrangement, since the vertical truss members 43 are positioned at the frame unit face, the upper and lower cord truss members can be used as positioning reference points, and the positioning and assembly of the vertical truss members 43 and cross members 45 is easy.

FIG. 7, shows a frame subassembly consisting of four frame units joined at common faces. The cross truss members 45 extending between the vertical members 43' are placed along lines $l_m$ passing through one of the centers of curvature $O_1$ or $O_5$. A connecting piece 60 is provided on each of the vertical truss members 43' for connecting the frame subassembly to adjacent frame subassemblies to form a frame structure. It is to be noted that the abutting surfaces of the connecting pieces 60 are positioned on the face of a frame unit and thus in a vertical plane passing through the line $l_m$. This arrangement facilitates the connection between adjacent frame subassemblies. While four connecting pieces 60 are provided in the vertical plane at the ends of the frame subassembly, any number of the connecting pieces 60 may be used. Also, the frame subassembly itself may be a partial polygonal unit, as illustrated, or may be straight. The connecting pieces 60 are placed in an abutting relationship with the mating connecting pieces 60 of adjacent frame subassemblies and may be secured by any securing means such as bolts and nuts.

In this embodiment, since the connecting faces of adjacent frame subassemblies are arranged on the same vertical plane passing through a center of curvature of the curved escalator, the following advantages are obtained:

(1) The connecting faces of the ends of the frame subassemblies can be used as reference faces for the assembly of the frame subassemblies.

(2) The connection between the respective frame subassemblies can be accurate.

(3) The manufacture of the frame subassembly is facilitated due to the presence of the reference face.

(4) The installation of the curved escalator system is facilitated by aligning the reference face of the frame subassemblies with the centers of curvature of the escalator.

What is claimed is:

1. A frame structure for a curved escalator comprising an outer side and inner side truss unit assembly, each of said assemblies including a plurality of truss units connected to each other to define an arc in plan, said frame structure having upper and lower horizontal sections and an intermediate sloped section between the upper and lower sections, said frame structure further comprising:

an upper transition section connected between said upper horizontal section and said sloped section, and a lower transition section connected between said lower horizontal section and said sloped section, each transition section having a slope less than that of the sloped section, each said truss unit including upper and lower cordal truss members and horizontally spaced first and second vertical truss members connecting said upper and lower cordal truss members;

means connecting said plurality of truss units of each of said assemblies to form said inners and outer side truss unit assemblies having adjacent cord portions connected at angled junctures and vertical truss members disposed substantially at said junctures; and horizontal cross members, each lying along a local radius of curvature of said frame structure and extending transversely of and connecting between a vertical truss member of said inner side truss unit assembly and a corresponding vertical member of said outer side truss unit assembly such that said inner and outer vertical members and the horizontal member connecting said inner and outer vertical members all lie in a vertical plane containing a local radius of curvature of said frame structure.

2. A frame structure as claimed in claim 1 in which all the faces of all the frame units are of identical dimensions.

3. A frame structure as claimed in claim 2 including a first frame unit with a first and second face and a second frame unit with a first and second face, said first and second frame units connected with a common face such that an inner vertical member, an outer vertical member, and a horizontal member of the first face of the first frame unit constitute an inner vertical member, an outer vertical member, and a horizontal member, respectively, of the second face of the second frame unit.

4. A frame structure as claimed in claim 3 in which all of the faces of all of the frame units are of identical dimensions.

5. A frame structure as claimed in claim 3 further including connecting means on a face of a frame unit which is not a common face.

* * * * *